United States Patent [19]

Valentine

[11] 4,103,072

[45] Jul. 25, 1978

[54] METHOD OF PRODUCING DIAZOTYPE PHOTOPRINTING MATERIAL

[75] Inventor: Irving R. Valentine, Chicago, Ill.

[73] Assignee: Weber-Valentine Company, Inc., Elk Grove Village, Ill.

[21] Appl. No.: 703,970

[22] Filed: Jul. 9, 1976

Related U.S. Application Data

[62] Division of Ser. No. 621,129, Oct. 9, 1975, abandoned.

[51] Int. Cl.[2] ..... D21H 5/08

[52] U.S. Cl. ..... 428/425; 96/49; 96/75; 96/85; 96/91 R; 427/161; 427/391; 428/447; 428/511; 428/512; 428/514

[58] Field of Search ..... 96/49, 75, 85, 91 R; 427/161, 391; 428/425, 447, 511, 512, 514

[56] References Cited

U.S. PATENT DOCUMENTS

| | | | |
|---|---|---|---|
| 3,352,677 | 11/1967 | Kosalek | 8/119 X |
| 3,457,100 | 7/1969 | Levene | 427/391 |
| 3,813,261 | 5/1974 | Muller | 427/391 X |

FOREIGN PATENT DOCUMENTS

| | | | |
|---|---|---|---|
| 8108/61 | 5/1969 | Japan | 427/161 |

*Primary Examiner*—Michael R. Lusignan
*Attorney, Agent, or Firm*—Vogel, Dithmar, Stotland, Stratman & Levy

[57] ABSTRACT

There is disclosed a method of producing diazotype photoprinting material in which a base paper is withdrawn from a supply roll and transported through a precoating station in which a solution containing a silicon filler is applied to one side of the base paper; the paper is then transported from the precoating station past a plurality of heaters to a sensitizing station in which a solution containing a diazotype sensitizing compound is applied to one side of the base paper; the base paper is then transported past a second set of heaters to a transparentizing station in which a solution containing a water emulsion of a water clear synthetic organic resin is applied to the other side of the base paper simultaneously to render the base paper translucent and to decurl the paper; the paper is then transported past a third set of heaters to dry the paper to a moisture content of about 4% and finally is wound into a roll. A method of transparentizing any water absorbent natural fiber material is also disclosed.

5 Claims, 1 Drawing Figure

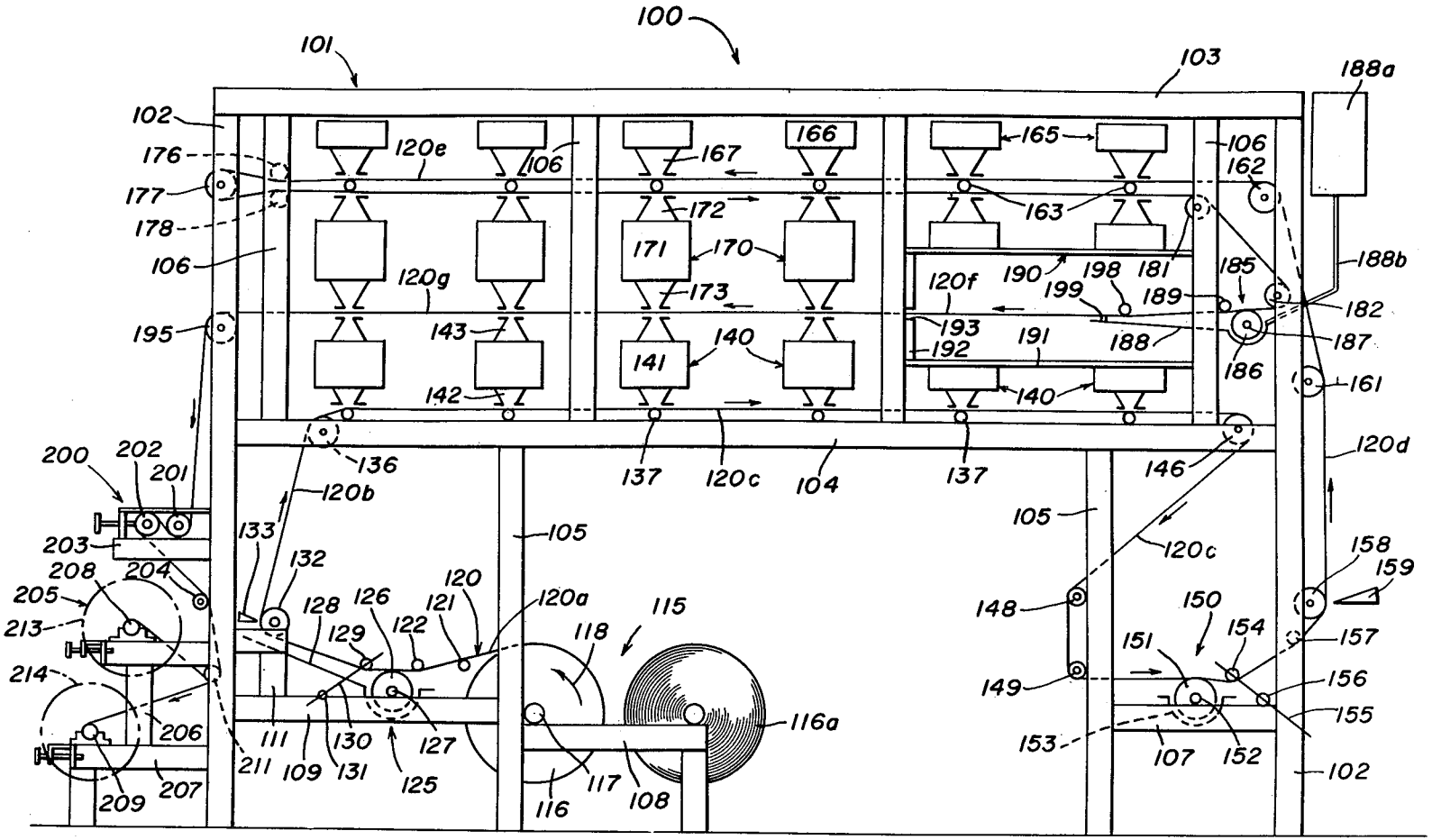
100
101
102
103
104
105
106
107
108
109
111
115
116
116a
117
118
120
120a
120b
120c
120d
120e
120f
120g
121
122
125
126
127
128
129
130
131
132
133
136
137
140
141
142
143
146
148
149
150
151
152
153
154
155
156
157
158
159
161
162
163
165
166
167
170
171
172
173
176
177
178
181
182
185
186
187
188
188a
188b
189
190
191
192
193
195
198
199
200
201
202
203
204
205
206
207
208
209
211
213
214

METHOD OF PRODUCING DIAZOTYPE PHOTOPRINTING MATERIAL

This is a divisional of application Ser. No. 621,129, filed Oct. 9, 1975, now abandoned, the subject matter of which is present in the continuation filed July 5, 1977 as Ser. No. 812,575.

BACKGROUND OF THE INVENTION

This invention relates to a method of producing transparent, water absorbent natural fiber material, a method of producing diazotype photoprinting material and more particularly to a method of continuously producing diazo intermediate translucent paper.

A principal object of the present invention is to provide a method of producing diazotype photoprinting material comprising continuously contacting one side of a web of base paper with a solution containing a diazotype sensitizing composition, drying the sensitized web of base paper, and continuously contacting the other side of the dried web of sensitized paper with a transparentizing water emulsion of a water clear synthetic organic resin to render the sensitized paper translucent, whereby continuously to produce a translucent diazotype photoprinting paper.

Another object of the present invention is to provide a transparent water absorbent natural fiber material a method of producing same wherein a water emulsion of water clear resin is used to transparentize normally opaque materials.

A further object of the present invention is to produce a diazo intermediate paper by the method set forth in which a separate decurling is not needed since use of a water emulsion of a water clear resin provides simultaneous transparentization and decurling.

Yet another object of the present invention is to provide a method of transparentizing paper and the product produced thereby, wherein a water emulsion of a water clear resin is utilized to wet at least one side of a base paper.

Further objects and advantages of the present invention will be better understood by reference to the single drawing which is a schematic and diagramatic drawing of machinery for carrying out the process of the present invention.

DESCRIPTION OF THE PREFERRED EMBODIMENTS

Turning now to the single sheet of drawing, there is disclosed in the FIGURE a machine 100 which may be used to carry out the method of the present invention, the machine 100 including a frame 101 having four spaced-apart end posts 102 forming generally a rectangle in plan view. Spaced-apart and parallel horizontal top bars 103 connect the end posts 102 and two horizontal top bars perpendicular to the bars 103 are not shown; the frame 101 further includes two spaced-apart horizontally disposed middle bars 104, each of the bars 104 interconnecting two of the end posts 102. The frame 101 also includes four spaced-apart vertical supports 105 extending downwardly from the middle bars 104 (only two being shown) and a plurality of upper vertical supports 106 extending between the middle bars 104 and the horizontal top bars 103.

The frame 101 further includes a horizontal support 107 interconnecting the right-handmost lower vertical support 105 and the adjacent end post 102, a horizontal support 108 forming a part of the supply station 115 hereinafter to be explained and a horizontal support 109 interconnecting the left-handmost vertical support 105 with the adjacent end posts 102; the horizontal support 109 carries on the top thereof a roller support 111 also fixedly connected to the associated end posts 102.

There is further provided a supply station 115 in which a roll of base paper 116 is supported by its spindle 117 or core which rests on the horizontal support 108; an extra supply of base paper 116a is also shown. The roll of base paper 116 is unwound in a counter-clockwise direction, see arrow 118, to provide a continuous web of base paper 120; the web of base paper 120 is unrolled from the periphery of the supply roll 116 over a control roller 121, beneath a control roller 122 to the precoating station 125.

The precoating station 125 includes a wetting roller 126 mounted on a spindle 127 which is driven by a motor (not shown) and also includes a drip pan 128 supported between the roller support 111 and the horizontal supports 109, the drip pan 128 for holding a precoating solution hereinafter set forth. The precoating station 125 further includes a pressure roller 129 mounted between two spaced-apart arms 130 which are pivoted as at 131, the pressure roller 129 serving to maintain contact between the surface of the wetting roller 126 and one side of the web 120, thereby to contact the one side of the web 120 with a precoating solution contained in the drip pan 128 and carried from the drip pan to the web 120 by rotation of the wetting roller 126 about the spindle 127 in a counter-clockwise direction.

The web 120 after it has been contacted by the precoating solution is denoted as **120*b* and passes around a backup roller 132 past an air knife 133 which directs a forced stream of air onto the side of the web 120*b* which has the precoating solution on it to remove excess precoating solution from the web 120*b***.

From the precoating station 125, the web **120*b* passes over an idler roller 136 suitably journalled between the horizontal supports 104 and over a plurality of horizontally disposed longitudinally spaced-apart web supports 137**.

A plurality of heaters 140 are longitudinally spaced apart, each of the heaters 140 having an air plenum 141 and a downwardly disposed nozzle 142 and an upwardly disposed nozzle 143. Air heated from a source (not shown) is introduced into each plenum 141 and from there exits through the respective nozzles 142 and 143, each of the heaters 140 being located above a corresponding one of the web supports 137. The web **120*b*, as it travels from the precoating station 125 to the heaters 140, is wet with the precoating solution; however, by passing beneath the nozzles 142, the web is dried as at 120*c* and moves in the right hand direction to and over an idler roller 146 suitably journalled between the horizontal supports 104 at the right hand ends thereof. As the web 120*c* passes by the right handmost heater 140 and over the idler roller 146, it passes downwardly and diagonally to the left to the left-hand side of two spaced-apart vertically disposed idler rollers 148 and 149**.

When the web 120c passes around the idler 149, it is again horizontally disposed and enters the sensitizing station 150. The sensitizing station 150 includes a wetting roller 151 suitably journalled on a spindle 152 and driven by a motor (not shown), the sensitizing station 150 further including a drip pan 153 for holding a sensitizing solution therein. A pressure roller 154 is mounted between two spaced-apart and parallel arms 155 pivoted as at 156 to maintain a pressure on the web 120*d*, which web 120*d* is so characterized after having the sensitizing solution applied thereto by being contacted by the wetting roller 151 which carries the sensitizing solution from the drop pan 153 to the web 120*d*. After passing beneath the pressure roller 154, which insures contact between the web 120*d* and the roller 151, the web 120*d* passes around a control bar 157 fixedly mounted between the end posts 102 and around an idler roller 158 also suitably journalled to the end posts 102. An air knife 159 is suitably positioned adjacent the idler 158 to scrape or remove excess sensitizing solution from the web 120*d* by directing a stream of air forcefully against the side of the web 120*d* to which has been applied the sensitizing solution.

The web 120*d* is transported upwardly from the idler 158 part idlers 161 and 162, both suitably journalled between the end posts 102. As may be seen, the idlers 158, 161 and 162 are positioned so as to contact the web 120*d* on the side opposite to the side on which is applied the sensitizing solution from the sensitizing station 150, so as not to cause an uneven coating of the sensitizing solution to be applied to the web 120*d*.

From the idler roller 162, the web 120*d* passes over a plurality of web supports 163 and beneath a corresponding plurality of heaters 165. Each of the heaters 165 has an air plenum 166 and a downwardly disposed nozzle 167, the air plenums 166 each being supplied with a supply of heated air from a source not shown so as to direct the heated air through the nozzle 167 to contact the web 120*e*, so characterized after the web 120*d* has been dried by the heaters 165. After the web 120*e* passes the left-handmost heater 165, the web 120*e* passes beneath a control roller 176 suitably journalled between the left-handmost ones of the vertical supports 106 and around an idler roller 177 suitably journalled between the left-handmost end posts 102. The web 120*e* thereafter passes over a control roller 178 and past another plurality of heaters 170. Each of the heaters 170 includes an air plenum 171, an upwardly disposed nozzle 172 and a downwardly disposed nozzle 173. The plurality of heaters 170 correspond in number and position to the plurality of heaters 140 and 165 so as to direct opposed air flows onto the web 120*e*, in order to dry the same. After the web 120*e* has passed the right-handmost one of the heaters 170, the web 120*e* passes over an idler roller 181 and an idler roller 182 respectively journalled on the right-handmost vertical support 106 and the right hand end posts 102 and enters the transparentizing station 185.

The transparentizing station 185 includes a wetting roller 186 suitably journalled on a spindle 187 rotated by a motor (not shown), the transparentizing station also including a drip pan 188 for holding a transparentizing emulsion, all as hereinafter set out. A storage tank 188*a* and pipe 188*b* are shown in communication with the pan 188 so as to maintain a supply of emulsion therein. There is further provided two pressure rollers 189 and 198 which contact the web 120*f*, so designated after the transparentizing emulsion has been applied to the heated and dried web 120*e*, on the side of the web opposite to the side on which is applied the transparentizing emulsion. There is further provided a scraper bar 199 located toward the rear or the left-handmost end of the drip pan 188, so as to scrape excess transparentizing emulsion from the surface of the web 120*f* prior to the time that the web 120*f* is heated.

Immediately to the left of the transparentizing station 185 is an insulated chamber 190, the insulated chamber 190 including two spaced-apart and parallel top and bottom walls 191, two spaced-apart and parallel end walls 192 and two spaced-apart and parallel side walls (not shown). The left-handmost end wall 192 contains therein a horizontally extending slot 193, which slot 193 is of sufficient width so as to allow the web 120*f* having the transparentizing emulsion applied to the one side thereof to pass through the slot 193 and between the heaters 140 and 170. The insulating chamber 190 is optional, but is provided so that the transparentizing emulsion does not become gummy and foul the equipment. If desired, an optional air knife can be provided after the web exits the transparentizing station to doctor excess emulsion. The chamber 190, if necessary, maintains the web 120*f* below the boiling point of the transparentizing emulsion prior to the time that excess transparentizing emulsion can be scraped or removed from the web 120*f*. If the temperature inside the chamber 190 gets too high, ventilating means may be provided to reduce the temperature to the desired value.

From the insulated chamber 190, the web 120*f* having the transparentizing emulsion applied to the one side thereof is transported past a plurality of heaters 170 and 140, each of the heaters being juxtaposed or in facing relationship so that the lowermost nozzle 173 of each of the heaters 170 is aligned with an uppermost nozzle 143 of each of the heaters 140 so as to direct heated air from the respective air plenums 171 and 141 to and through the web 120*f* so as to dry the transparentizing emulsion thereon, the dried web being designated 120*g*. From the heating zone, the dried web 120*g* passes over an idler roller 195, which idler roller 195 is suitably journalled between the left-handmost end posts 102 of the frame 101.

A drive mechanism 200 is provided at the left-handmost end of the machine 100, the drive mechanism 200 including two rubber-covered driven rollers 201 and 202, the web 120*g* passing downwardly and underneath the roller 201 and upwardly between the rollers 201 and 202 and over and around the roller 202. The rollers 201 and 202 are contained in a housing 203. From the roller 202, the web 120*g* passes diagonally downwardly to the right around a control roller 204 suitably journalled to the left-handmost end posts 102 and to the storage station 205. As may be seen, the web 120 is pulled, not pushed, through the machine 100.

The storage station 205 includes a frame 206 and 207 which forms a support for the respective wind-up rolls 213 and 214. Each of the frames 206 and 207 respectively supports a driven roller 208 and 209, the rollers being driven by means (not shown), whereby the web 120*g* passing from the control roller 204 around an idler 211 suitably journalled on the end posts 102 to either one of the driven rollers 208 or 209 to be wound up to form a roll 213 or 214, respectively. As may be seen, the driven rollers 208 and 209 may be used simultaneously where the web 120*g* consists of several lengths of paper arranged side-by-side, or the rolls 208 and 209 may be used alternatively to form a first roll 213 and thereafter a second roll 214.

The machine 100 just described has been used to manufacture diazo intermediate translucent paper, the web 120 being run at a rate of 3,000 yards per hour or 150 feet per minute, the machine 100 having a frame size of about 28 feet by 6 feet by 6 feet; the base paper was 100% rag. 14 to 20 pounds basis weight.

While there has been set forth a machine on which the method of the present invention may be practiced, it is intended to be an example only and not definitive of the various types of machines which may be utilized to practice the method of the present invention. The various solutions or emulsions applied at the precoating station 125, the sensitizing station 150 and the transparentizing station 185 will hereinafter be set forth.

Precoating of the web 120 may be accomplished by the use of a water solution of silicon particles and a resin or protein binder. The precoating solution is standard in the art and produces a smooth surface, it being understood that the precoating station 125 is not necessary to produce an operable diazo intermediate translucent paper. However, it is preferred because the final product is superior with the aforementioned precoat than without it.

The heaters 140 have supplied thereto air heated to a temperature of up to about 300° F., whereby the web **120*b*** may be heated to a temperature of between about 200° F. and about 300° F. so as to dry the same as indicated at 120*c*.

The sensitizing solution provided at the sensitizing station and applied to the side of the web **120*c*** opposite to the side which the precoating solution was applied contains an unreacted diazo and a diazo coupling compound. The sensitizing solution may contain any one of a number of art-recognized, light-sensitive diazo compounds which are stable as the corresponding diazonium sulfates, chlorides, fluorosilicates or fluoroborates, such as para-diazo diphenylamine sulphate, diazo compounds which are stabilized as the corresponding zinc chloride or other metallic chloride salt comprises, or diazo compounds which are stabilized as salts of sulfonic acids or aryl sulfonic acids. These include:

(a) Para-diazo diethylamilene zinc chloride
(b) 1 diazo-2 oxy naphthalene-4 sulfonate
(c) p-diethyl amino benzene diazonium chloride $ZnCl_2$
(d) 4-benzoylamino-2-5-diethyoxy benzene diazonium chloride
(e) Para-chlorobenzene-sulfonate of 4-diazo-N-cyclohexylaniline
(f) Para-chlorobenzene-sulfonate of 4-diazo-2-methoxy-1-cyclohexylamino benzene
(g) Tine chloride double salt of 4-N-methylcyclohexylamino benzene diazonium chloride
(h) p-Acetamino benzene diazonium chloride
(i) 4-dimethylamino benzene diazonium chloride
(j) 3-methyl 4-diethyl amino benzene diazonium chloride
(k) 4-morpholino benzine diazonium chloride
(l) 4-piperidyl 2-5-diethyoxy benzene diazonium chloride
(m) 1-dimethyl amino naphthalene-4-diazonium chloride The diazo coupling component may be replaced by other compositions capable of removal of a hydrogen ion for combination with the chloride ion of the diazo dye formation. Such compounds are preferably selected of the organic compounds in the form of aromatic amines such as aniline or substituted aniline of the type dimethylaniline or phenolic compounds such as phenol, resorcinol, phloroglucinol, 2,3-dihydroxy naphthalene 6-sulfonic acid, 1-naphthiol 4,7-disulfonic acid, 2-naphthol, 3,6-disulfonic acid, aceto acetanilide and its substitution products, phenyl methyl pyrazolone and its substitution products, thio compounds such a thio barbituric acid, or cyano compounds such as cyanoacetamide. The choice of diazo coupling component is also subject to the desired color change since one diazo coupling component will give one color with one diazo and another diazo coupling component will give another color with the same diazo compound.

Following is an example of sensitizing solution:
Water: 1 liter, temperature 100°–120° F.
Citric Acid: 4%
Thio Urea: 7%
Zinc Chloride: 4%
P-Diazo dimethylanalinezincchloride: 3%
Resin: 1%
Resorcinol: 2%

As may be seen, the above components are well known in the art and the exact diazo compounds are diazo coupling compounds or the proportion in which they are combined do not form a part of this invention.

The transparentizing solution provided at the transparentizing station 185 is a water emulsion of a water clear resin, thereby eliminating the necessity of organic solvents such as toluene, xylene or the like. The water emulsion consists of a water clear resin such as a low molecular weight polypropylene, low molecular weight polystyrene, polyvinyl chloride, styrene butadiene, carboxylated styrene butaliene, silicone resins and urethanes. The emulsifier used to make the water emulsion may be chosen from polyoxethylated fatty acids, simple fatty esters, sorbitan esters, ethoxylated fatty amines, ethoxylated sorbitan esters, ethoxylated vegetable oils, ethoxylated alcohols and ethoxylated alkylphenols.

The method of transparentizing at the station 185 is novel since heretofore resins have been provided in organic solvents, which solvents are volatile, combustible and noxious. Organic solvents such as xylene and toluene are health and pollution hazards, and produce noxious smoke when subjected to elevated temperatures for drying. The emulsifiers useful in the transparentizing emulsion of the present invention may be present in the amount of from about 0.5% by weight to about 2.0% by weight. The amount of emulsifier present is critical to the success of the transparentizing emulsion since too little emulsifier will not emulsify the water clear resin in the water carrier and thereby the paper will not be transparentized and too much emulsifier will cause the image to be pulled from the surface through to the back surface, resulting in streaking and an unsatisfactory image.

The water clear resin is generally present in an amount from about 6% by weight to about 17% by weight, depending upon the actual water clear resin that is used. Other water clear resins which may be used in lieu of or in combination with polypropylene are: polystyrene, polyvinyl chloride, styrene butadiene, carboxylated styrene butadiene, silicone resins, and urethanes.

The preferred water clear resin is polypropylene are the preferred emulsifier is a polyoxethylated fatty acid sold by the General Aniline and Film Corporation under the trade designation "VN-430". The polyoxyethylated fatty acid emulsifier is non-ionic; is a free flowing liquid at 25° C.; has a ten maximum color on the varnished colored scale; has a specific gravity of 0.9 to 1.0; is insoluble but readily dispersible in water; has a neutralization number in milligrams of potassium hydroxide per gram of sample to a pH of 7.0 of 0.5 max. The active contents of the emulsifier as sold is 99% minimum with a maximum moisture content of 0.5 weight percent. In the present invention the preferred formula is 1 quart of the above-referenced VN-430 GAF emulsifier with 14-¼ gallons of low molecular weight polypropylene resin combined and made up to 25 gallons with water. Accordingly, it is seen that the preferred transparentizing emulsion has between 0.9 and 1.1 percent by weight of the preferred emulsifier to the total transparentizing emulsion and this amount of emulsifier is critical.

As hereinbefore stated, the amount of the emulsifier may be varied within the ranges of 0.5% to about 2% and the amount of resin may be varied in the range of from about 6% to about 17% depending upon the emulsifier and the resin chosen. In all cases, however, for each combination of resin and emulsifier, the exact percent of emulsifier is critical in order on the one hand to maintain the water clear resin in emulsion and on the other hand prevent the image from being pulled from the surface. The transparentizing emulsion just described is novel as is the continuous process described and the product produced thereby.

Another aspect of the present method is the drying of the web 120*e* between the sensitizing station 150 and the transparentizing station 185. The web 120*e* is heated to a temperature of between about 200° F. and about 300° F. which makes possible the continuous production of diazo intermediate translucent paper without the hereinbefore required storage of the paper subsequent to the application of transparentizing emulsion to allow for the curing of imperfections in the paper. Because of my novel process, diazo intermediate translucent paper can be continuously produced and distributed without elongated curing times and without using organic solvents in the transparentizing operation, a further advantage being that the paper produced by my novel process is less grainy and produces a sharper line image than paper produced in the usual manner. The exact mechanism by which superior line quality is obtained is not completely understood; however, paper produced by my novel process is superior in line quality to previously produced paper.

As hereinbefore set forth, the web 120*e* is dried by heating to a temperature of between about 200° F. and about 300° F. prior to the time that the web 120*e* enters the transparentizing station 185. The heaters 140, 165 and 170 are shown in the machine 100 as being forced air heaters; however, it is within the scope of the present invention that the web 120*e* may be heated by means other than forced air heat, all as well known in the art. The final web 120*g* is dried until a moisture content of between about 3% to about 6% is reached, with a preferred content being about 4%.

The optional insulating chamber 190 prevents gumming of the equipment by temporarily insulating the transparentizing emulsion from the heating effect of the heaters 140, 165 and 170 so as to prevent an increase in viscosity of the low molecular weight synthetic organic resin used as the active ingredient in the transparentizing emulsion. It is further noted that the transparentizing emulsion provides decurling of the web as well as transparentizing the web, whereby a separate decurling station is no longer needed.

Since a water emulsion is used in the transparentizing station 185, the web 120 need not be transported to a separate chamber after passing through the transparentizing station 185 in order to have excess transparentizing emulsion evaporated therefrom as was needed when an organic solvent was used in the transparentizing station. In lieu of the machine described, a machine produced by The Andrews Paper and Chemical Co., Inc., known as the Andrews-Knowlton aqueous coater may be used.

In addition to the paper described, 100% rag. of over 24 pounds basis weight has been transparentized with the water emulsion described. Laminating papers, heavy index weight papers, useful as lamp shades, have been transparentized. Also, cotton fibers can be transparentized with the water emulsion of the present invention. Any water absorbent natural fiber material can be transparentized if the material is in the form of relatively thin sheets.

In view of the foregoing, it is apparent that there has been provided a method of producing diazotype photoprinting material. There has also been described a method of transparentizing water absorbent natural fibers and the product produced thereby. While there has been described what is at present considered to be the preferred embodiment of the invention, it will be understood that various modifications may be made therein and it is intended to cover in the appended claims all such modifications as fall within the true spirit and scope of the invention.

What is claimed is:

1. A method of transparentizing a water absorbent natural fiber material consisting essentially of contacting at least one side of the material with an effective amount of a water emulsion of a water clear synthetic organic resin, said emulsion containing a emulsifier present in the range of from about 0.5% to about 2% by weight of the emulsion, said emulsifier is selected from the class consisting of polyoxyethylated fatty acids, simple fatty acids, sorbitan esters, ethoxylated fatty acids, ethoxylated fatty amines, ethoxylated sorbitan esters, ethoxylated vegetable oils, ethoxylated alcohols and alkylphenols, said water clear resin being present in the range of from about 6% to about 17% by weight of the emulsion, said water clear synthetic organic resin is selected from the class consisting of polypropylene, polystyrene, polyvinyl chloride, styrene butadiene, carboxylated styrene butadiene, silicone resins, and urethanes.

2. The method set forth in claim 1, wherein said material is paper.

3. A translucent water absorbent natural fiber material comprising a water absorbent natural fiber material having absorbed therein an effective amount of a water emulsion of a water clear synthetic organic resin, said water emulsion containing an emulsifier present in the range of from about 0.5% of about 2% by weight selected from the class consisting of polyoxethylated fatty acids, simple fatty esters, sorbitan esters, ethoxylated fatty acids, ethoxylated fatty amines, ethoxylated sorbitan esters, ethoxylated vegetable oils, ethoxylated alcohols and alkylphends, said water clear resin being present in the range of from about 6% to about 17% by weight selected from the class consisting of polypropylene, polystyrene, polyvinyl chloride, styrene butadiene, carboxylated styrene butaliene, silicone resins and urethanes.

4. The translucent material set forth in claim 3, wherein said natural fiber material is paper.

5. The translucent paper set forth in claim 4, wherein said paper is up to 100% rag, 10 to 24 pounds basis weight, said emulifier is a polyoxethylated fatty acid present in the range of from 0.9% to 1.1% by weight, and said water clear resin is polypropylene present in the range of from 8% to 12% by weight.

* * * * *